US005988970A

United States Patent [19]

Holtom

[11] Patent Number: 5,988,970

[45] Date of Patent: Nov. 23, 1999

[54] LOADER ARM ASSEMBLY

[75] Inventor: Stephen Wayne Holtom, New South Wales, Australia

[73] Assignee: Ferndale Investments Pty Limited, Sydney, Australia

[21] Appl. No.: 09/000,327

[22] PCT Filed: Jul. 17, 1996

[86] PCT No.: PCT/AU96/00452

§ 371 Date: Jan. 15, 1998

§ 102(e) Date: Jan. 15, 1998

[87] PCT Pub. No.: WO97/03901

PCT Pub. Date: Feb. 6, 1997

[30] Foreign Application Priority Data

Jul. 17, 1995 [AU] Australia ..... PN4211

[51] Int. Cl.[6] ..... B65F 3/06

[52] U.S. Cl. ..... 414/408; 414/546; 414/733

[58] Field of Search ..... 414/406, 408, 414/421, 486, 487, 546, 733

[56] References Cited

U.S. PATENT DOCUMENTS

| | | | |
|---|---|---|---|
| 2,774,494 | 12/1956 | Malmström | 414/546 |
| 3,820,673 | 6/1974 | McVaugh | 414/546 |
| 4,286,916 | 9/1981 | Evans | 414/546 |
| 4,872,801 | 10/1989 | Yeazel et al. | 414/409 |
| 5,256,027 | 10/1993 | Guest | 414/408 X |
| 5,391,039 | 2/1995 | Holtom | 414/408 |

FOREIGN PATENT DOCUMENTS

| | | | |
|---|---|---|---|
| 629165 | 7/1992 | Australia | 414/408 |
| 0312900 | 4/1989 | European Pat. Off. . | |
| 433517 | 1/1991 | European Pat. Off. | 414/408 |
| 1288003 | 1/1969 | Germany | 414/406 |
| 3216483 | 11/1983 | Germany . | |
| 3811460 | 10/1988 | Germany . | |
| 897650 | 1/1982 | U.S.S.R. | 414/408 |
| 91/05721 | 5/1991 | WIPO . | |
| 92/01612 | 2/1992 | WIPO . | |
| 93/22227 | 11/1993 | WIPO . | |

*Primary Examiner*—James W. Keenan
*Attorney, Agent, or Firm*—Abelman, Frayne & Schwab

[57] ABSTRACT

A loader arm assembly (10) includes a primary arm (11) pivotally mounted on a refuse collector (13) at or adjacent one of its ends, a secondary arm (15) connected to the other end of the primary arm (11), a grab assembly (17) connected to the other end of the secondary arm (15) and means for pivoting the primary arm (11) including a ram (31) connected to the point at which the primary arm (11) is connected to the refuse collector (13) and a cylinder (30) which has one link (32) connecting it to the refuse collector (13) and another link (33) connecting it to the primary arm.

11 Claims, 9 Drawing Sheets

LOADER ARM ASSEMBLY

TECHNICAL FIELD

This invention relates to a refuse loader arm assembly and more particularly to a loader arm assembly for loading refuse contained in a bin into a larger storage chamber. The refuse loader arm may be mounted on a refuse collection/compaction vehicle.

BACKGROUND ART

It is known to construct refuse loader arm assemblies utilising the principle of pivotally extendible and retractable arms. The arm assembly may include two or more pivotally connected limb members and terminate in a grab device adapted to grab the bin containing refuse. The limb members may be actuated so as to cause the arm assembly to extend pivotally towards the bin so that the grab device will be in a position to grab the bin. Once grabbed, the bin may be lifted to a dumping position over the refuse storage chamber in the collection/compaction vehicle by reverse actuation of the limb members.

However, these prior art arm assemblies generally require a separate actuation of the grab device to cause the bin to tilt to its dumping position so as to discharge its contents into the storage chamber. The tilting of the bin has normally been achieved by the actuation of a hydraulic cylinder operable between the outer most limb of the arm assembly and the grab device. The grab device tilt cylinder works in concert with the other cylinders operable mounted on the limb members.

It is an object of this invention to provide an improved loading assembly suitable for use with refuse collection/compaction vehicles.

SUMMARY OF THE INVENTION

According to the invention there is provided a loader arm assembly adapted to raise a refuse bin to a dump position, said loader arm assembly comprising a primary arm adapted to be pivotally mounted on a refuse collector at or adjacent one of its ends, a secondary arm connected to the other end of the primary arm, a grab assembly connected to the other end of the secondary arm and means for pivoting the primary arm including a cylinder and ram arrangement in which the ram is connected to the point at which the primary arm is connected to the refuse collector and the cylinder has one link connecting it to the refuse collector and another link connecting it to the primary arm.

BEST MODE FOR CARRYING OUT THE INVENTION

Figure 1:
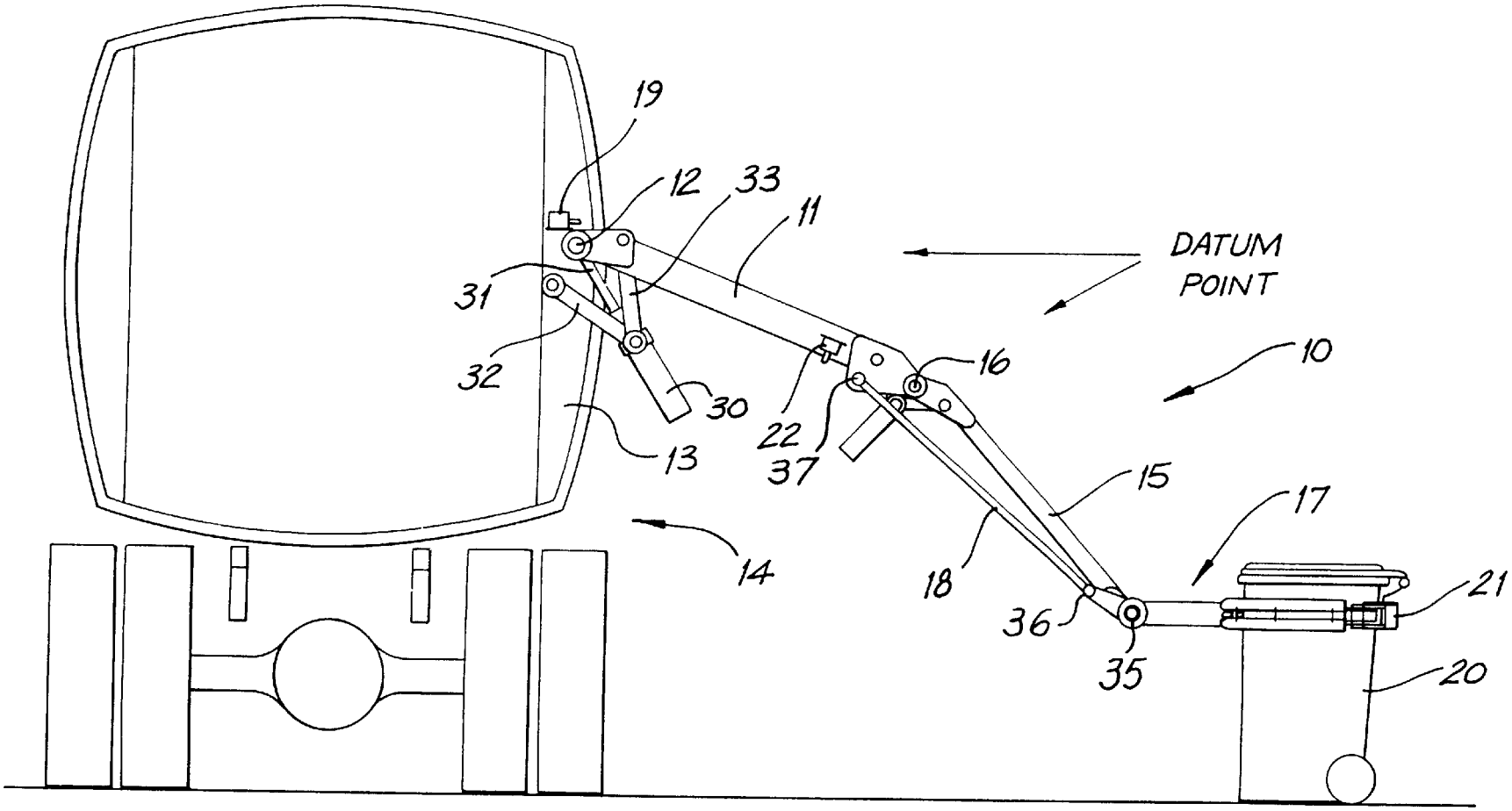
FIG. 1 is a side elevational view of a loading assembly for a refuse collection/compaction vehicle according to one embodiment of the invention.

The loader assembly 10 shown in FIGS. 1 to 9 has a primary arm 11 which is mounted via a pivot point 12 to the side of a refuse collector which, in this instance is the compaction chamber 13 of refuse vehicle 14. A secondary arm 15 is pivoted from the other end of the primary arm 1 1 at pivot point 16.

A container grab assembly 17 is mounted on the other end of the secondary arm 15. The grab assembly 17 is kept in relation to the primary arm 11 by means of a linkage 18 which is attached to the grab assembly 17 at a connection point 36 spaced apart from pivot point 35. The linkage 18 is also attached to the primary arm 11 at a connection point 37 spaced apart from the pivot point 16.

Figure 2:
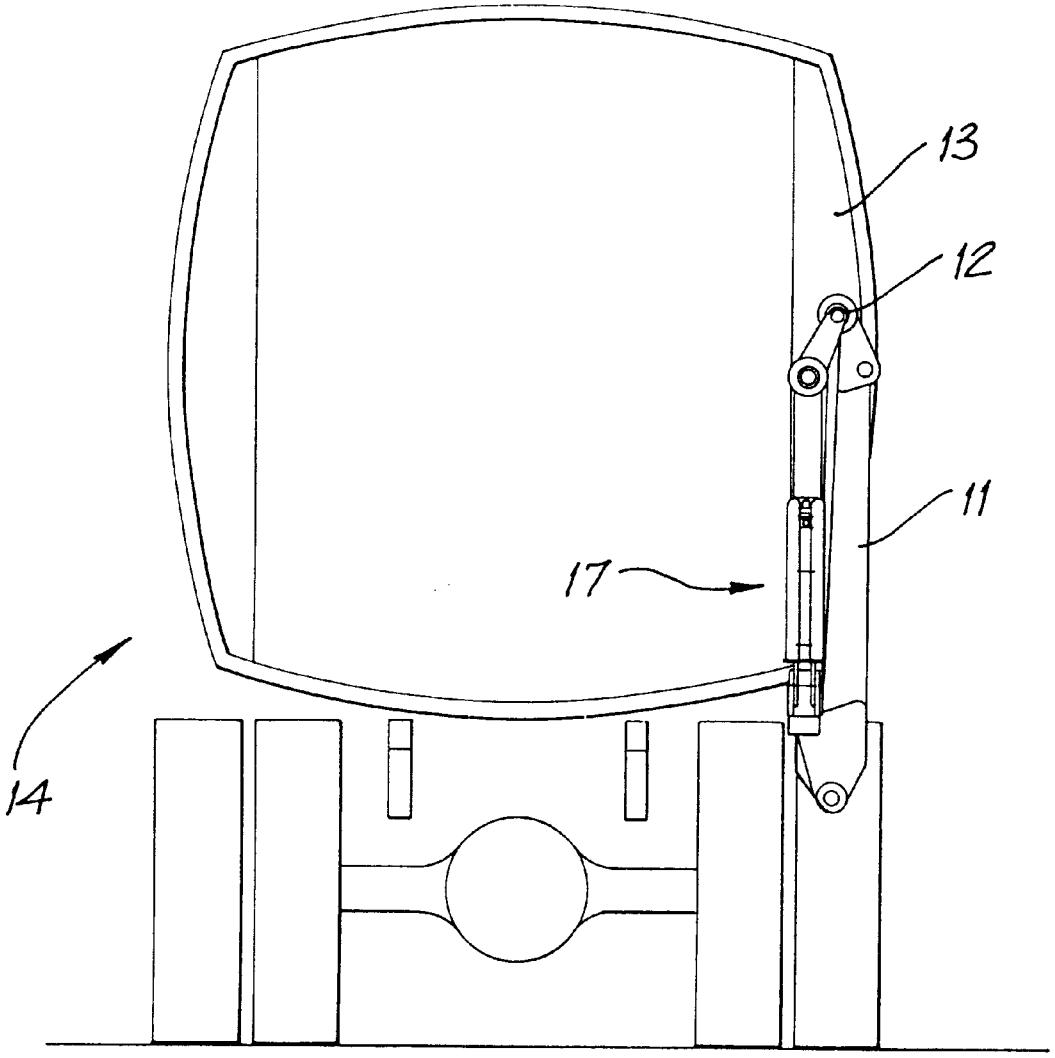
FIG. 2 is a view similar to FIG. 1 with the loading assembly stored against the vehicle.

In the normal rest position for the loader assembly 10, the primary arm 11 points vertically down from its pivot point 12 with the secondary arm 15 tucked vertically up behind the primary arm and the grab assembly 17 is located, pointing down, beside the primary arm 11 and the secondary arm 15—see FIG. 2. The rest position presents a compact configuration which does not protrude far from the side of the compaction chamber 13 of the vehicle 14.

The first movement of the loader assembly 10 occurs when the operator directs the primary arm 11 upward. This action rotates the primary arm 11 and secondary arm 15 as well as the grab assembly 17 around the primary arm pivot point 12 until it reaches the datum point as illustrated in FIG. 1.

When the primary arm 11 has reached this datum point, a limit switch 19 overrides the operator's directions and stops the movement 9 the primary arm 11. To recommence the movement of the primary arm 11 the operator must centralise the control joystick to cancel the signal and then redirect the arm upward or downward.

Under normal operation, once the primary arm 11 has stopped in the datum position, the operator directs the secondary arm 15 to rotate outward towards the container. The datum point of the primary arm 11 is set such that the secondary arm 15 does not clash with the side of the compaction chamber 13 as it is rotated.

As the secondary arm 15 is rotated outward, linkage 18 directs the grab assembly 17 into a horizontal relationship to the primary arm datum position. This function presents the grab assembly 17 in the correct relationship to the container 20, thus allowing the grab 21 to engage the container 20 for the next stage of the loading operation.

The rotation of the secondary arm 15 carries the grab assembly 17 through an arc towards the container 20, thus providing the reach function necessary to grab containers 20 that are a distance from the vehicle 14.

Figure 7:
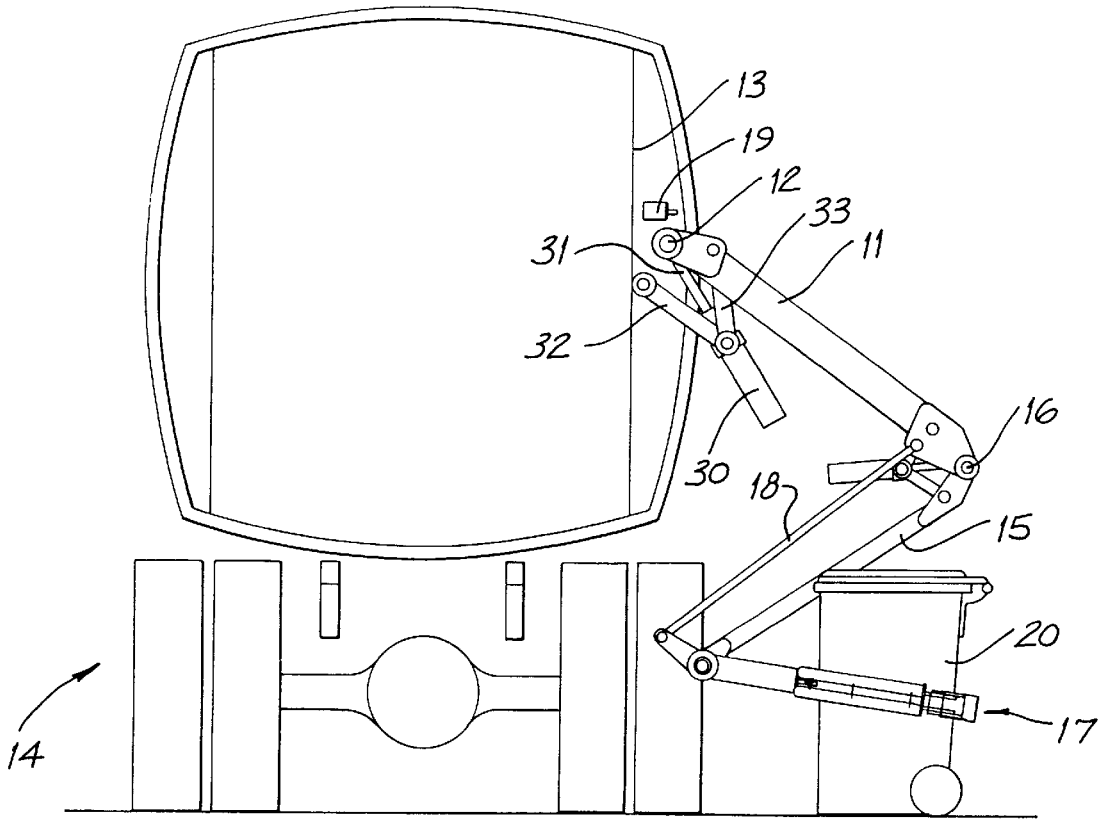
FIG. 7 is a view similar to FIG. 5 showing the grab assembly engaging the refuse container.
Figure 8:
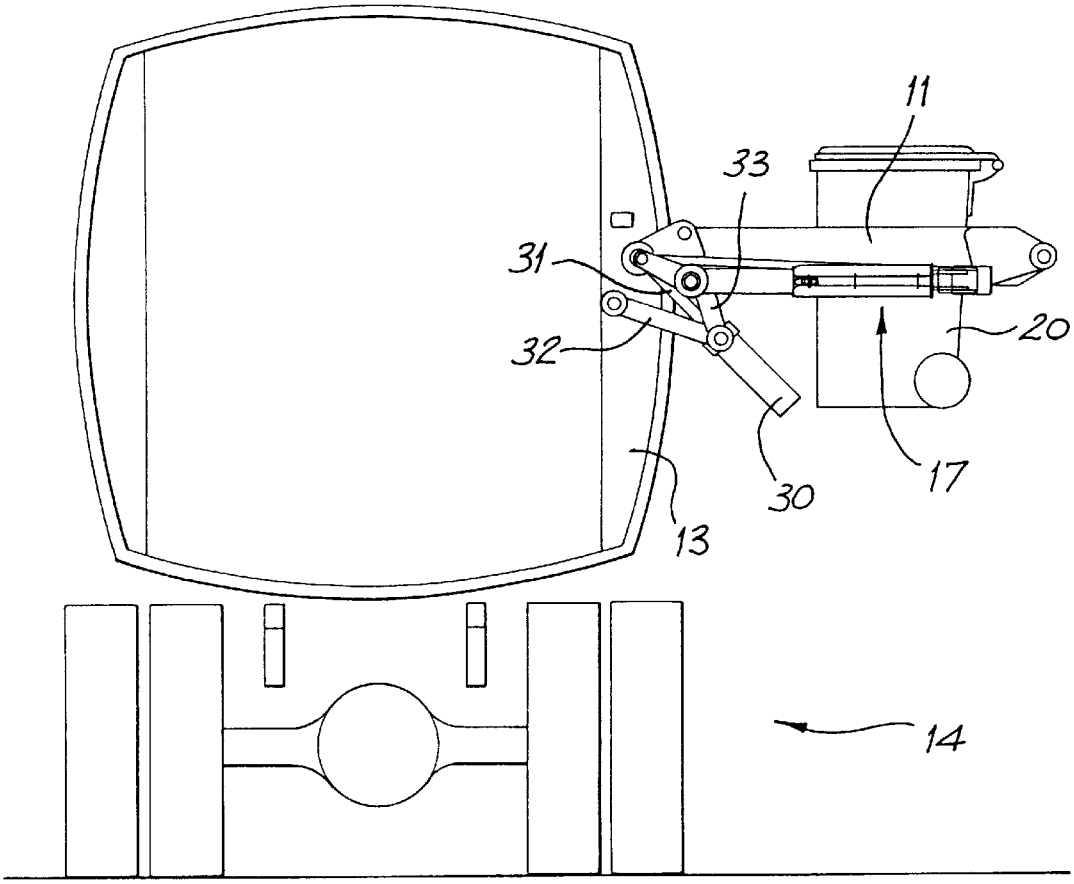
FIG. 8 is a view similar to FIG. 7 showing the refuse container being elevated.
Figure 9:
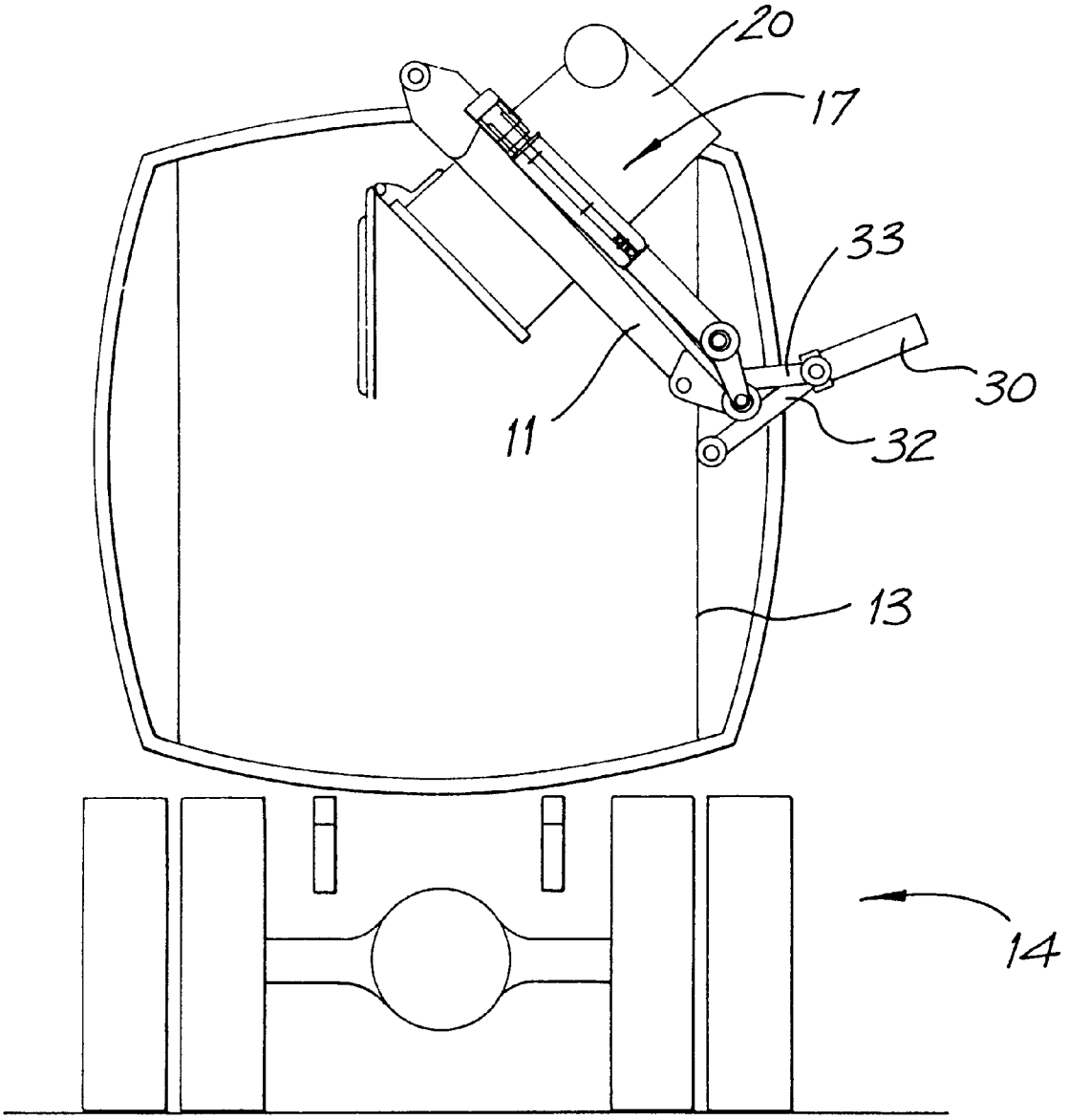
FIG. 9 is a view similar to FIG. 8 showing the refuse container being emptied.

Once the container 20 has been grabbed (refer FIGS. 1 or 7), the operator simultaneously directs the primary arm 11 to lift and the secondary arm 15 to retract, thus moving the container 20 back towards the pivot point and rotating it to an inverted position above the compaction chamber 13 (see FIGS. 8 & 9). This represents the discharge position for the container 20.

Once the refuse has been discharged from the container 20, the operator directs the primary arm 11 downward and the secondary arm 15 outward to reposition the container close to its original position beside the vehicle 14.

The grab mechanism 21 is then opened to release the container 20 and the operator directs the primary arm 11 downward and the secondary arm 15 inward, back to the rest position. The linkage 18 ensures that the grab assumes its rest position. A limit switch 22 prevents the primary arm 11 from rotating fully downward until the secondary arm 15 has tucked into a safe position behind the primary arm 11, thus preventing the risk of it clashing with the side of the compaction chamber 13.

The movement of the primary arm 11 and secondary arm 15 may be actuated by a "follower style" hydraulic cylinder or by a semi-rotary type actuator. The primary arm 11 rotation is likely to be in the order of 270 degrees, while the secondary arm 15 rotation is likely to be of the order of 180 degrees but movement may be provided by semi-rotary actuator or direct acting linear actuator and linkage.

Figure 3:
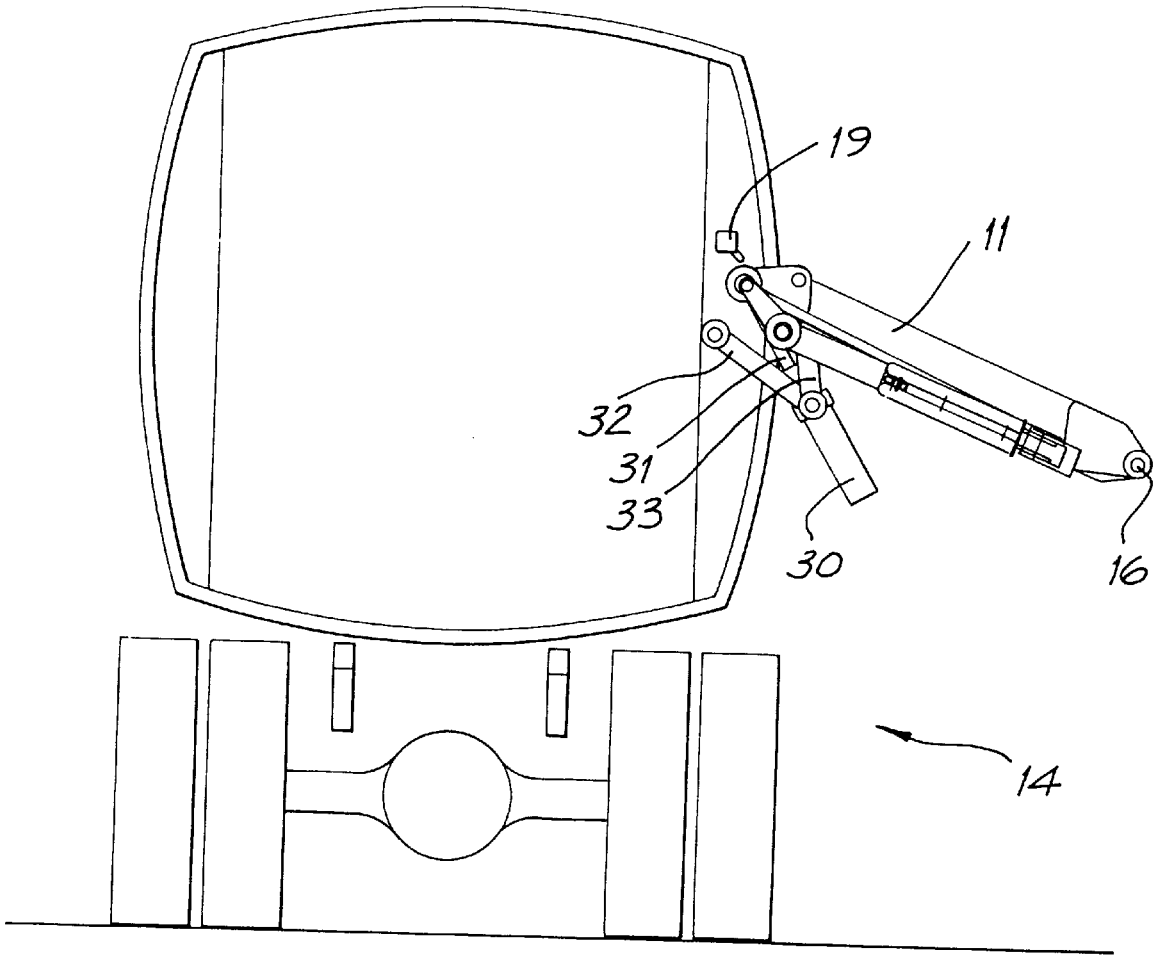
FIG. 3 is a view similar to FIG. 2 with the primary arm moved to its datum position.

In this embodiment, the loader assembly 10 is operated by a cylinder 30 having a ram 31 that is connected to pivot point 12. The cylinder 30 is connected to the compaction chamber 13 by link 32 an to the primary arm 11 by link 33. When the loader assembly 10 is in the position shown in FIG. 2, the ram 31 is fully extended. Retraction of the ram 31 into the cylinder 30 causes the cylinder 30 to rotate anti-clockwise and raise the primary arm 11 as shown in FIG. 3.

Figure 4:
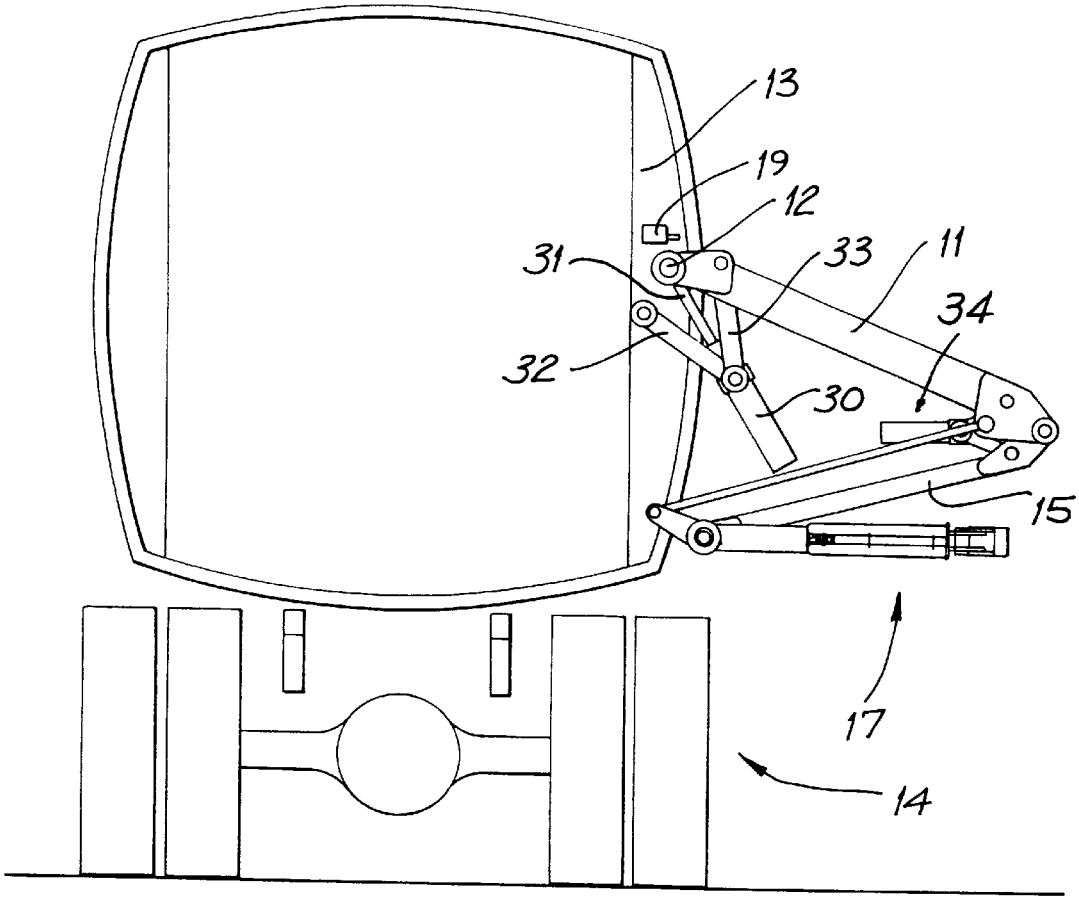
FIG. 4 is a view similar to FIG. 3 showing the initial downward movement of the secondary arm and grab assembly.
Figure 5:
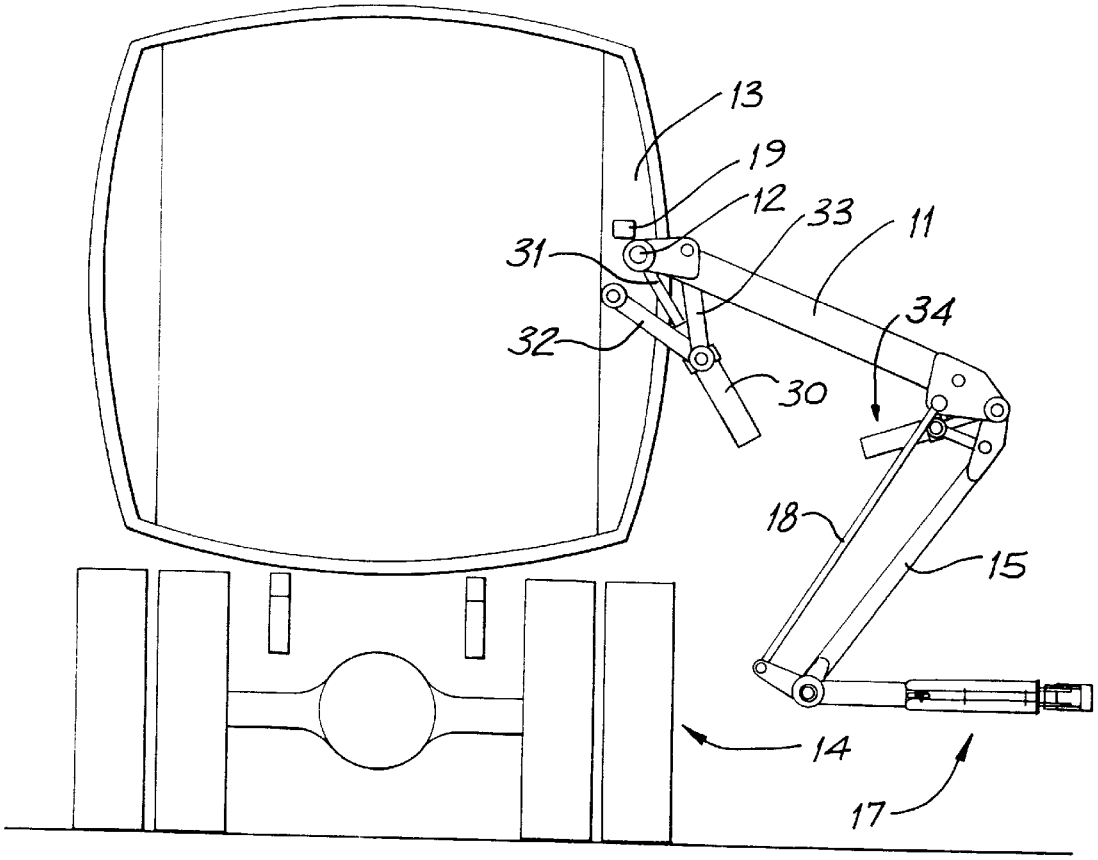
FIG. 5 is a view similar to FIG. 4 showing the outward movement of the grab assembly as the secondary arm is further rotated to pick up a refuse container adjacent the vehicle.
Figure 6:
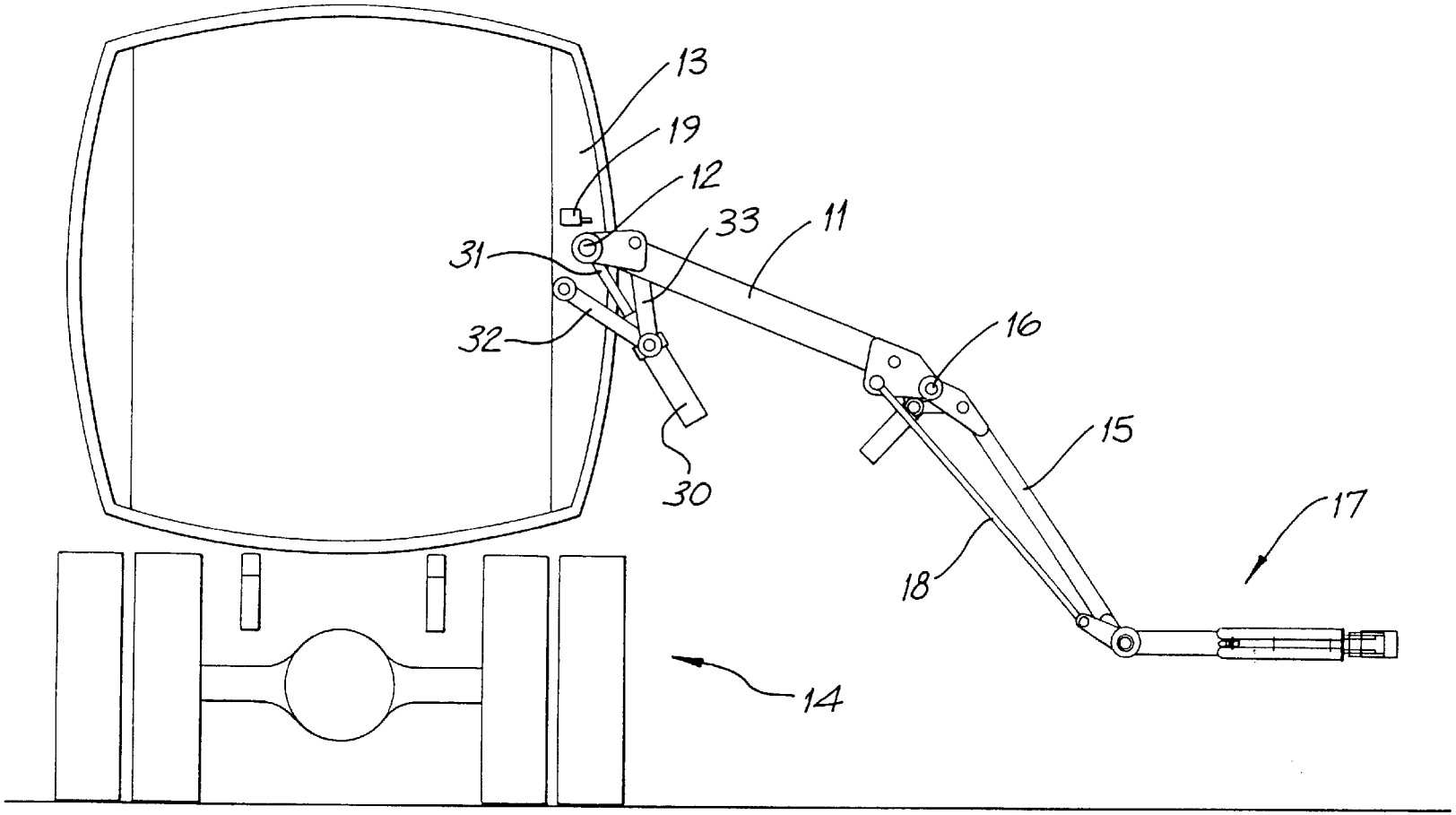
FIG. 6 is a view similar to FIG. 5 with the grab assembly extended to pick up a refuse container remote from the vehicle.

After refuse container 20 has been engaged by the grab 21, further retraction of the ram 31 will rotate the primary arm 11 anti-clockwise as shown in FIGS. 8 and 9. Movement of the secondary arm 15 with respect to the primary arm 11 is controlled by cylinder and ram 34 as shown in FIGS. 4 and 5.

Because the transport location of "rest position" for the loader assembly is downward, the normal operation is a single movement. That is to say, the loader 10 rotates up and out to collect the container 20, then continues the same upward travel to carry the container 20 to the discharge position, before reversing the movement to reposition the container before returning to the rest position. The loader 10 does not have to repeat the movement to return to the rest position. In this way, the number of movements as well as the speed of the movements have been reduced by 50% while still achieving an acceptable productivity level.

Because the primary arm 11 datum point is controlled by the limit switch 19 and the risk of clash between the secondary arm 15 and the compaction chamber 13 has been eliminated, the operator does not need a high degree of skill in order to achieve the basic functional requirements of the loader. Also, the operation of the lift function automatically positions the container 20 in the discharge position above the compaction chamber 13. The linkage 18 assures that the grab assembly is always presented in the correct relationship to the container 20 and retracts to its safe position when the loader arm 10 is returning to the rest position. These factors all make the loader easier to operate which in turn improves the productivity of the collection/compaction machine 14.

Because the loader mechanism 10 consists of two basic arms 11 and 15 as well as linkage 18, it is very easy to manufacture. Maintenance costs and reliability have also been improved because of the reduced number of pivot points. This simplicity of design also provides the benefit of reduces mass, thus reducing deceleration stresses and improving the vehicle's effective payload.

Because the loader 10 is mounted from the side of the compaction chamber 13 which is structurally strong, there is no need for a heavy and expensive mounting assembly which must be fixed to the chassis of the vehicle. In this way, the weight, cost and chassis stress have been reduced.

By independently modifying the relationship between the primary arm 11 and secondary arm 15, after reaching the datum position, the operator can move the grab 21 very close to the side of the vehicle 14 to collect containers 20 in the close proximity (see FIG. 7). At the same time, the operator can collect containers 20 which are a significant distance from the vehicle 14 (see FIG. 1). This versatility also allows for the collection of containers which are above or below road level.

The action of the secondary arm 15 brings the grab mechanism 17 and therefore the container 20 closer to the main pivot point. This has the effect of reducing the radial distance and therefore the velocity of the container, thereby also reducing the stresses produced by the deceleration of mass a high speed.

By using a position feedback system, an electronic unit can automatically move the secondary arm 15 proportionally and in relation to the primary arm 11, thus keeping the grab assembly 17 relatively level during the reach operation. This option further reduces the operator's functional requirements. This same system can record the position in which the container was grabbed and automatically return it to this position after discharging its contents.

INDUSTRIAL APPLICABILITY

The loader arm assembly may be used to discharge a mobile refuse bin into the compaction chamber of a refuse collection vehicle.

The claims defining the invention are as follows:

1. A loader arm assembly adapted to raise a refuse bin to a dump position, said loader arm assembly comprising a primary arm adapted to be pivotally mounted on a refuse collector at or adjacent a first end of the primary arm, a secondary arm connected at a first end to a second end of the primary arm, a grab assembly connected to a second end of the secondary arm and means for pivoting the primary arm including a cylinder and ram arrangement in which the ram is connected to a point at which the primary arm is adapted to be connected to the refuse collector and the cylinder has one link adapted for connection to the refuse collector and another link connecting it to the primary arm.

2. A loader arm assembly adapted to raise a refuse bin to a dump position, said loader arm assembly comprising:

(i) a primary arm adapted to be connected to a refuse collector for pivotal movement about a first pivot point at or adjacent to a first end of the primary arm;

(ii) a secondary arm connected to a second end of the primary arm for pivotal movement about a second pivot point at or adjacent to a first end of the secondary arm;

(iii) a grab assembly connected to a second end of the secondary arm for pivotal movement about a third pivot point at or adjacent to a first end of the grab assembly; and (iv) a primary drive means for pivoting the primary arm, said primary drive means including a cylinder and ram arrangement in which the ram is connected to the first pivot point at which first pivot point the primary arm is adapted to be connected to the refuse collector, and the cylinder has a first link adapted to be connected to the refuse collector and a second link connected to the primary arm.

3. A loader arm assembly according to claim 2 and further including a secondary drive means for pivoting the secondary arm with respect to the primary arm, the loader arm assembly being moveable when not in use to a retracted position where the primary arm extends downwardly from the first pivot point, the secondary arm extends upwardly from the second pivot point and is located behind the primary arm, and the grab assembly extends downwardly from the third pivot point.

4. A loader arm assembly according to claim 3 and further including control means adapted to operate the primary drive means to pivot the primary arm from the position of the primary arm when the loader arm assembly is in the retracted position to a predetermined datum position and to operate the secondary drive means after the primary arm has reached its datum position to pivot the second arm and hence the grab assembly away from the refuse collector to an extended position at which is located a refuse bin.

5. A loader assembly according to claim 4 wherein the control means is further adapted to cause the grab assembly to engage the refuse bin when the grab assembly is in the extended position and then to retract the grab assembly and secondary arm by operating the secondary drive means so that the refuse bin is moved to a lifting position, the control means being further adapted to operate the primary drive means to pivot the primary arm above its datum position so that the refuse bin is moved to a dump position above the refuse collector.

6. A loader arm assembly according to claim 5 wherein the control means is further adapted to operate the primary drive means to rotate the primary arm downwards from the dump position to the datum position and to then operate the secondary drive means to pivot the secondary arm and hence the grab assembly outwards from the refuse collector to unload and empty the refuse bin.

7. A loader arm assembly according to claim 6 wherein the control means is further adapted to operate the secondary drive means to retract the secondary arm and hence the grab assembly to a position beneath the primary arm and thereafter to operate the primary drive means to pivot the primary arm downwards to the position of the primary arm when the loader arm assembly is in the retracted position.

8. A loader arm assembly according to claim 2 and further including a link connected between the grab assembly and the primary arm, the link being connected to the grab assembly at a first connection point spaced from the third pivot point and to the primary arm at a second connection point spaced from the second pivot point so as to maintain a predetermined relationship between the grab assembly and the primary arm when the loader arm assembly is being moved.

9. A loader arm assembly according to claim 4 and further including a first limit switch adapted to be engaged by the primary arm when it has reached its datum position, said limit switch being connected to the control means which renders the primary drive means inoperative when the primary arm has reached the datum position.

10. A loader arm assembly according to claim 9 and further including a second limit switch on the primary arm adjacent to the second pivot point and adapted to be operated by the secondary arm when it is retracted beneath the primary arm, the second limit switch being connected to the control means to permit the primary drive means to pivot the primary arm downwardly after the secondary arm and grab means have been retracted beneath the primary arm.

11. A loader arm assembly adapted to raise a refuse bin to a dump position, said loader arm assembly comprising:

(i) a primary arm adapted to be mounted on a refuse collector for pivotal movement about a first pivot point at or adjacent to a first end of the primary arm;

(ii) a secondary arm connected to a second end of the primary arm for pivotal movement about a second pivot point at or adjacent to a first end of the secondary arm;

(iii) a grab assembly connected to a second end of the secondary arm for pivotal movement about a third pivot point at or adjacent to a first end of the grab assembly;

(iv) a primary drive means for pivoting the primary arm about the first pivot point, said primary drive means including a cylinder and ram arrangement in which the ram is connected to the first pivot point, and the cylinder has a first link adapted to be connected to the refuse collector and a second link adapted to be connected to the primary arm;

(v) a secondary drive means for pivoting the secondary arm about the second pivot point; and (vi) a link connected between the grab assembly and the primary arm, the link being connected to the grab assembly at a first connection point spaced from the third pivot point and to the primary arm at a second connection point spaced from the second pivot point so as to maintain a predetermined relationship between the grab assembly and the primary arm when the loader arm assembly is being moved.

* * * * *